United States Patent [19]

Moll

[11] 4,144,676

[45] Mar. 20, 1979

[54] MACHINE TOOL HAVING FRAME MOUNTED HEAD AND TAIL STOCKS

[76] Inventor: Hans H. Moll, c/o Roland Offsetmaschinenfabrik Faber & Schleicher AG, 6050 Offenbach am Main, Fed. Rep. of Germany

[21] Appl. No.: 795,744

[22] Filed: May 11, 1977

Related U.S. Application Data

[63] Continuation-in-part of Ser. No. 721,973, Sep. 10, 1976, abandoned.

[30] Foreign Application Priority Data

Sep. 15, 1975 [DE] Fed. Rep. of Germany ..... 2541089

[51] Int. Cl.[2] ..... B24B 5/04

[52] U.S. Cl. ..... 51/105 R; 51/237 R; 51/232; 82/2 R

[58] Field of Search ..... 51/232, 237, 105 R, 51/105 SP, 105 CG; 82/2

[56] References Cited

U.S. PATENT DOCUMENTS

| | | | |
|---|---|---|---|
| 683,194 | 9/1901 | Bath | 51/232 X |
| 2,080,207 | 5/1937 | Hoppe | 82/2 |
| 2,132,924 | 10/1938 | Belden | 51/232 |
| 2,840,958 | 7/1958 | Waller | 51/232 X |
| 3,352,022 | 11/1967 | Fisk | 51/165.74 X |

*Primary Examiner*—Harold D. Whitehead

*Attorney, Agent, or Firm*—W. G. Fasse; W. W. Roberts

[57] ABSTRACT

The present machine tool comprises a grinding wheel rotatably mounted on a machine bed. A feed advance is movably mounted on the bed, and carries a vertical frame. Head and tail stocks are mounted in the vertical arms of the frame, for supporting a work piece to be moved with the feed advance table into engagement with the grinding wheel. The frame is angularly displaceable on the feed advance table about a vertical axis, to enable variation of the direction of feed with respect to the axis of a work piece mounted between the head and tail stocks.

6 Claims, 6 Drawing Figures

MACHINE TOOL HAVING FRAME MOUNTED HEAD AND TAIL STOCKS

BACKGROUND OF THE INVENTION

This invention is a continuation-in-part of copending application Ser. No. 721,973; filed: Sept. 10, 1976, now abandoned.

This invention is related to machine tools, and is particularly directed to machine tools having a material working tool, such as a grinder, mounted to a machine bed, and feed advance means for moving a work piece into engagement with the material working tool. While the invention is particularly useful in a grinding machine, as will be evident from the following paragraph, it will be noted that the invention may also advantageously be employed with other material working tools.

The concept of employing centerless grinder is known, wherein means may be provided for converting the grinder to a grinder of the form having head and tail stocks for holding a work piece. Such equipment is known, for example, from German Pat. No. 876,516. In the arrangement of this patent, however, the head and tail stocks must be secured independently and separately on the housing of the equipment, so that the retooling of the grinding machine, from centerless grinding to grinding with centered spots, was time consuming. In addition, retooling of the device disclosed in German Pat. No. 876,516 reduced the precision of the equipment.

OBJECTS OF THE INVENTION

It is therefore an object of this invention to provide a machine tool that overcomes the above disadvantages of prior machine tools.

A further object of the invention is to provide a machine tool, wherein a work piece may be readily, rotatably mounted for movement with respect to a material working tool, in a reliable and precise manner.

It is a still further object of the invention to provide means for readily and economically retooling a centerless grinding machine to a centered grinding machine having a head stock and a tail stock.

SUMMARY OF THE INVENTION

Briefly stated, in accordance with the invention, the above objects are achieved by providing a machine tool, wherein a material working tool is mounted on a machine bed, and a feed advance table is provided for moving a work piece handling device toward and away from the material working tool. The work piece holding device comprises a closed frame having aligned head and tail stocks in the opposite vertical arms. The frame may be angularly, displaceably mounted, about a vertical axis, on the feed advance table, in order to enable shifting or adjusting of the axis of the work piece with respect to the material working tool.

In the arrangement in accordance with the invention, the material working tool is advantageously a grinding wheel having a horizontal axis.

In accordance with a further feature of the invention, means may be provided on the upper horizontal member of the frame for attaching additional devices, such as work piece inserting devices and measuring devices.

The arrangement in accordance with the invention provides the further advantage that, by mounting the head stock and the tail stock in a closed frame, the elastic yielding of the receiving tips in the tail stock and in the quill or sleeve is avoided. In addition, in plunge type grinding employing a grinder in accordance with the invention, it is possible to grind not only diameters, but also shoulders in a work piece.

BRIEF FIGURE DESCRIPTION

In order that the invention may be clearly understood, it will now be described by way of example, with reference to the accompanying drawings, wherein.

DETAILED DESCRIPTION OF PREFERRED EXAMPLE EMBODIMENTS

Figure 1:
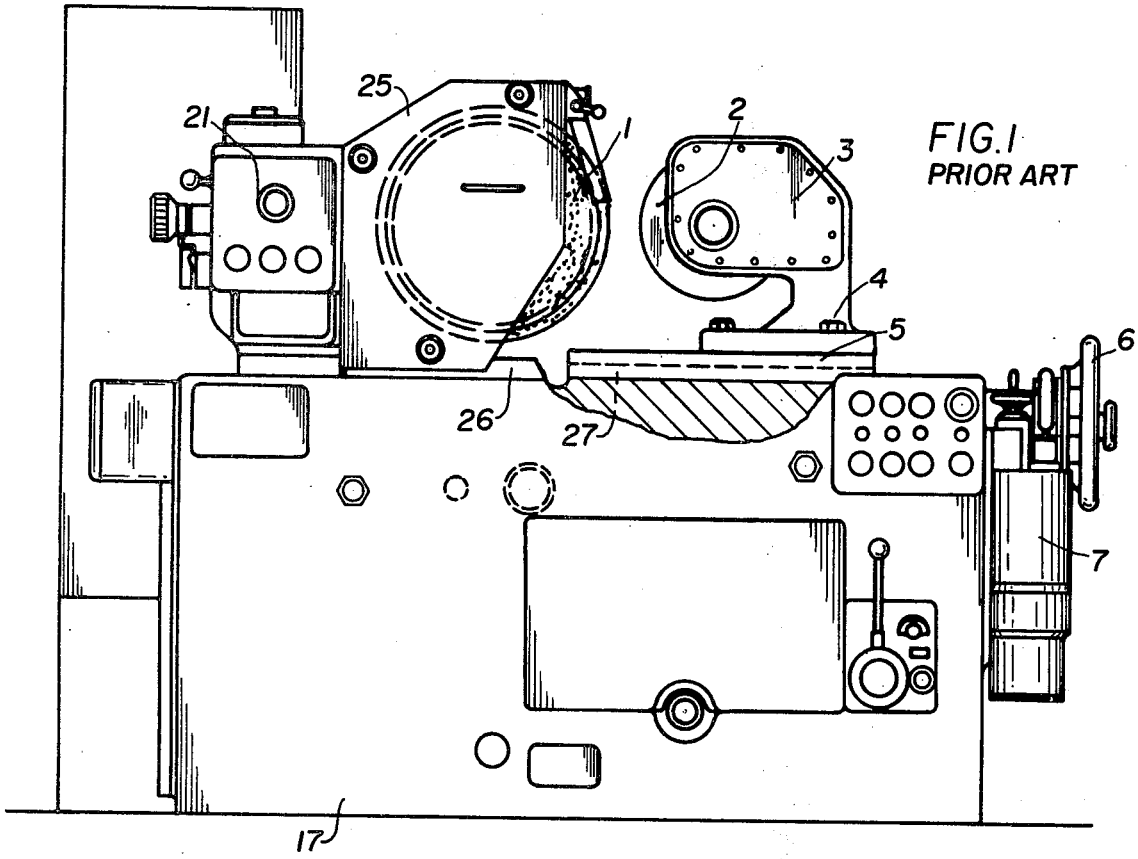
FIG.1 PRIOR ART
FIG. 1 is a side view of a known centerless grinder.

Referring now to FIG. 1, therein is illustrated a centerless grinder of generally known construction. This figure will hence only be discussed to the extent necessary to facilitate an understanding of the invention. The centerless grinder is comprised of a grinding wheel 1 mounted for rotation, preferably about a horizontal axis, on a machine bed 17. Insofar as the present invention is concerned, the grinding wheel 1 may be held in a fixed position with respect to the machine bed, although it will be apparent, that in accordance with conventional practice, the grinding wheel may be mounted for rotation, in a suitable housing 25, adapted for displacement, for example, along horizontal slides 26.

The centerless grinder is further comprised of a regulating or control disc 2 supported in a frame 3, the frame 3 being affixed, for example, by means of bolts 4 to a feed advance table 5. The feed advance table is slidably mounted on slides 27 on the machine bed, and a hand wheel 6 or other conventional means, such as an automatic feed advance device 7, is provided for moving the feed advance table, for example, by means of a feed advance screw (not shown). Thus, the feed advance table is movable in the direction defined by the plane of the grinding wheel, i.e., back and forth in the plane of the drawing.

Suitable other conventional controls may be provided on the equipment, but these details are not related to the present invention.

In the provision of a machine tool of the type illustrated in FIG. 1, it is frequently desirable to retool the equipment, so that the work piece may be held with fixed centers. For this purpose, the frame 3 may be removed by releasing the bolts 4, and suitable other work piece holding means may be bolted or otherwise affixed to the feed advance table. As discussed above, however, other previously employed work piece holding means in this type of structure have entailed relatively long retooling times, as well as decrease in the precision of the equipment.

Figure 2:
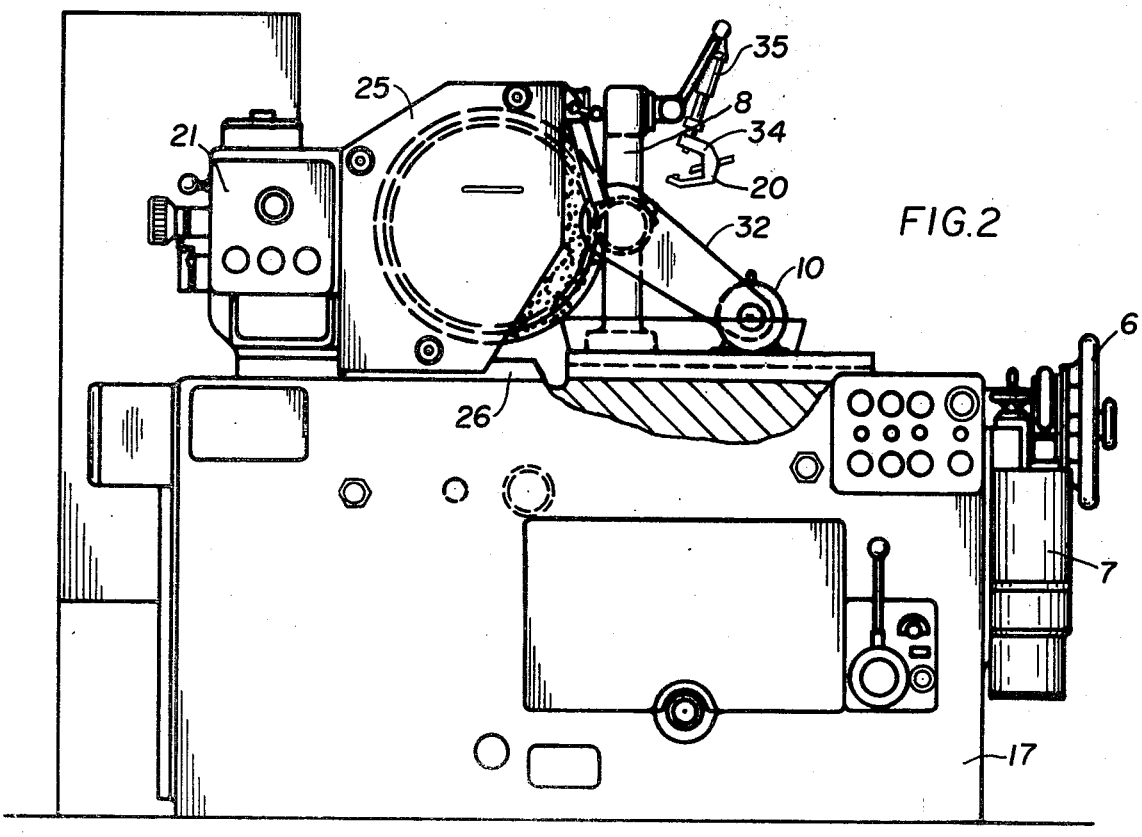
FIG. 2 is a side view of the grinder of FIG. 1, modified in accordance with the invention, to mount a work piece between head and tail stocks.
Figure 3:
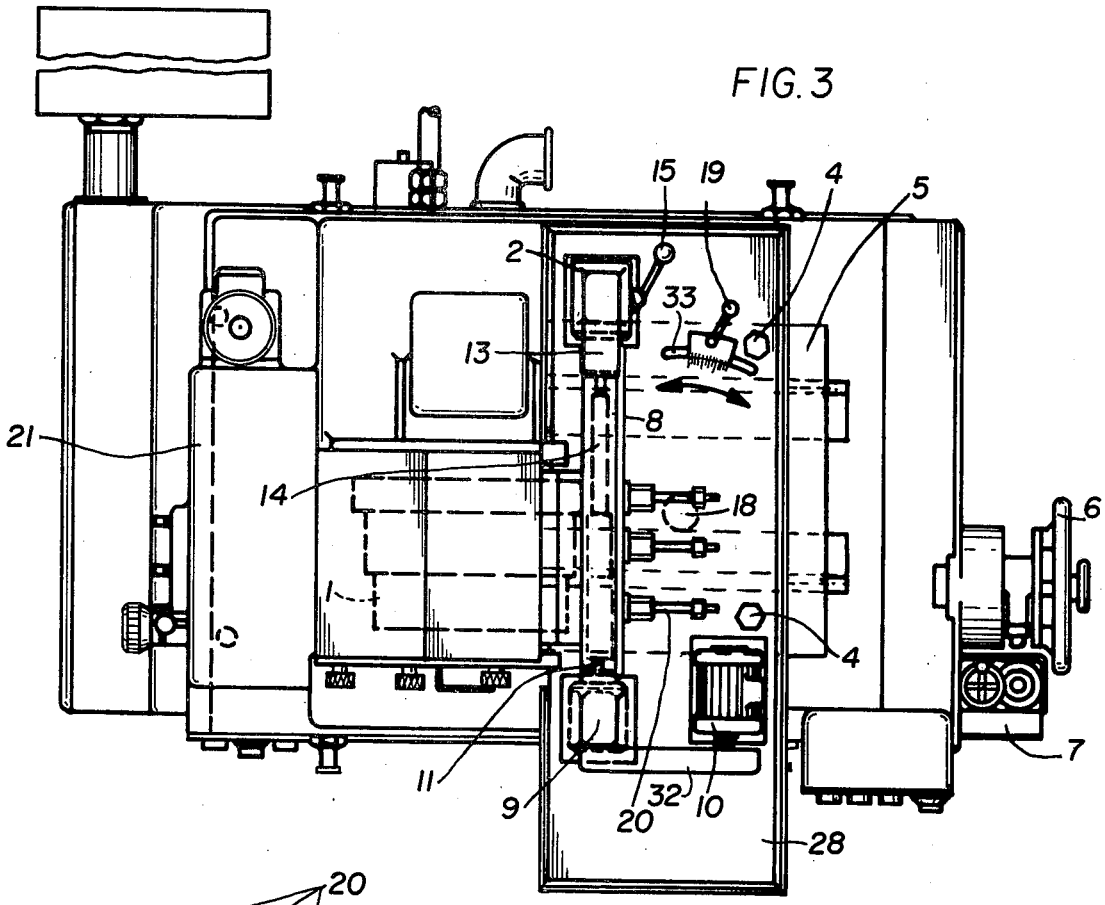
FIG. 3 is a top view of the grinder of FIG. 2.
Figure 4:
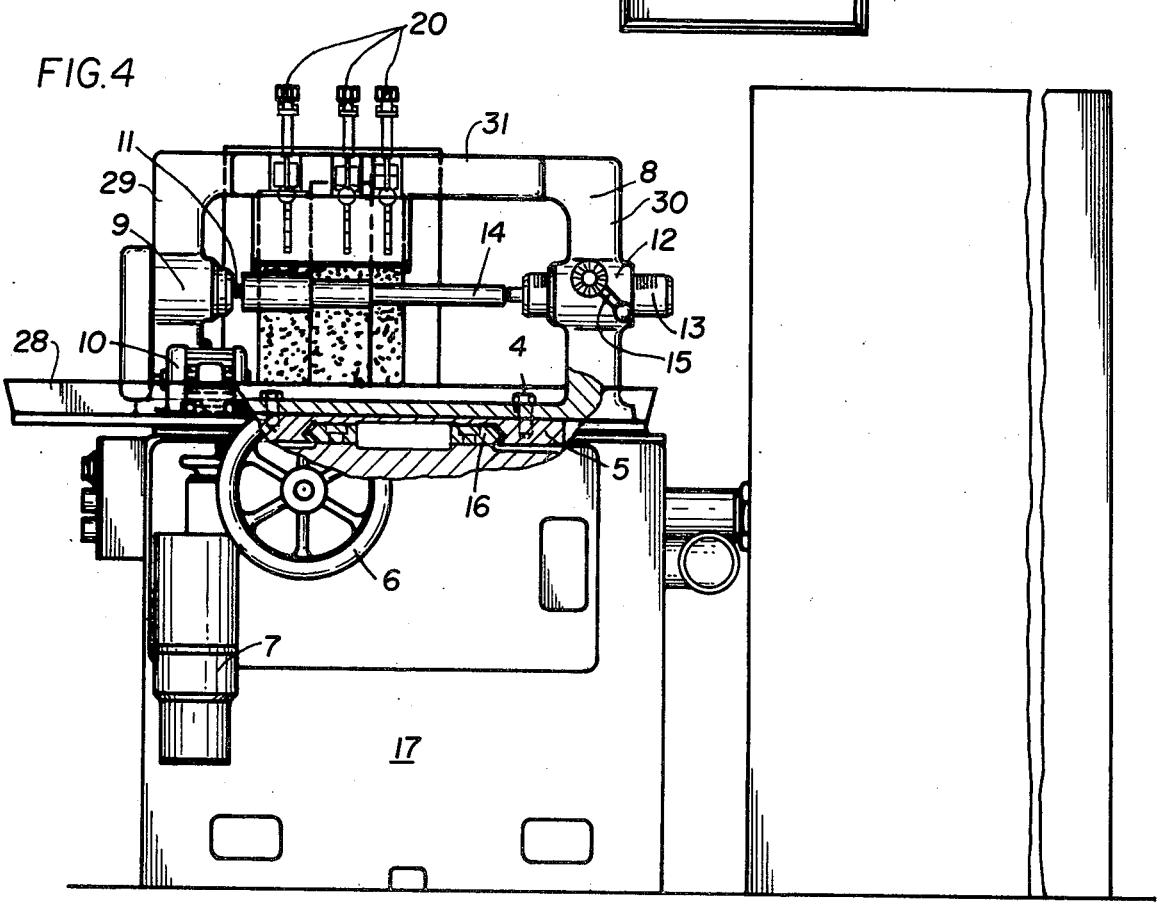
FIG. 4 is a partially cross sectional end view of the grinder of FIG. 3.

In accordance with the invention, as illustrated in FIGS. 2–4, the frame 3 of FIG. 1 is replaced by a closed frame 8 having a base 28, a pair of spaced apart vertical arms 29 and 30, and an upper cross connection 31 extending between the arms 29 and 30. The base 28 may be bolted, for example, by means of the bolts 4, to the feed advance table, for movement toward and away from the grinding wheel, with the feed advance table.

A head stock 9 is mounted in one vertical arm 29 of the frame, and a tail stock 12 is mounted in the other vertical arm 30. The head stock 9 carries a spindle 11 adapted to be driven by a motor 10 mounted on the base 28. For this purpose, for example, a conventional belt drive may be provided. The quill or sleeve 13 is adjustably mounted in its position in the tail stock 12, and aligned with the spindle 11, to receive and hold a work piece 14. The sleeve or quill 13 may be locked in by a conventional locking lever 15.

It is readily apparent from FIGS. 2–4 that, in accordance with the invention, a centerless grinding machine may be readily and simply converted to a center type grinding machine merely by replacing the centerless grinding frame 3 of FIG. 1 by the closed frame of FIGS. 2–4. The retooling of the grinding machine thereby requires a minimum amount of time, and due to the closed frame structure employed in accordance with the invention, the accuracy and precision of the device is not sacrificed, and elastic yielding of the receiving tips in the tail stock and in the quill or sleeve is avoided. The invention is particularly advantageous for the purpose of plunge grinding, since the attachment surface for the frame does not extend substantially beyond the width of the machine bed. The provision of the motor 10 on the frame 8, also lends to the structural and economic advantages of the arrangement in accordance with the invention.

In accordance with a further advantageous feature in accordance with the invention, an angular displacement may be selectively provided between the axis of the work piece 14 and the axis of the grinding wheel, so that the work piece may be fed to the grinding wheel in a desired direction in order to enable the grinding not only of diameters, but also shoulders in the work piece. For this purpose, as more clearly illustrated in FIG. 3, a vertically extending bearing stud 18 may be provided on the feed advance table 5, the stud 18 extending into a corresponding recess or hole in the base 28 of the closed frame. By removal of bolts 4, it is then possible to angularly displace the frame 8, with respect to the feed advance table, about a vertical axis. In order to fix the position of the frame upon such angular displacement, additional mounting holes (not shown) may be provided, for the bolts 4, to correspond to desired positions of the frame 8. Alternatively, as shown in FIG. 3, an arcuate slot 33, centered about the vertical axis of the stud 18, may be provided in the base 28, and a suitable bolt or other projection (not shown) may be provided extending into the slot 33 and adapted to be clamped by a clamping lever 19 on the base. The clamping of the frame 8 at the desired angular displacement thus may be effected by any conventional clamping technique.

As a further feature in accordance with the invention, measuring devices 20 may be conventionally mounted on the cross beam 31 of the frame 8, as illustrated in FIGS. 2–4, in order to monitor the machine or grinding of the work piece 14, or in order to control the working or grinding as a function of the graduated diameter of the grinding wheel 1. The measuring devices 20 may be comprised, for example, of micrometers 34 mounted on suitable adjustable levers 35, so that they may be positioned over the work piece during a grinding or machine operation. It will be apparent that other forms of measuring devices may alternatively be employed for monitoring or controlling the equipment.

While it does not form a part of the invention per se, FIG. 4 discloses in cross section, suitable conventional guides 16 secured to the machine base 17 in order to enable the linear movement of the feed advance table 5 toward and away from the grinding wheel. In addition, the machine may comprise an automatic truing device 21. Other conventional controls for the system are diagrammatically illustrated in the drawings, but do not form a part of the invention.

Figure 5:
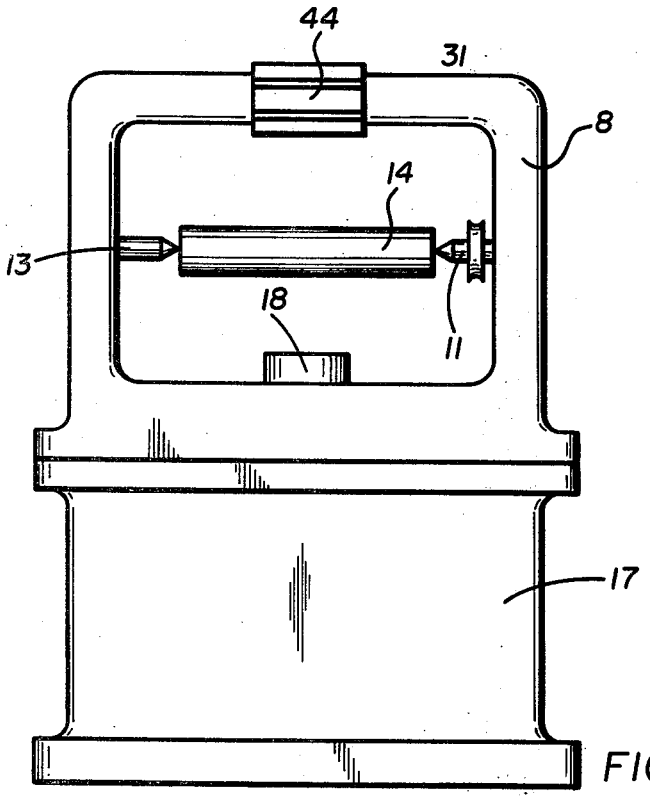
FIG. 5 is a simplified end view of a machine tool in accordance with the invention.
Figure 6:
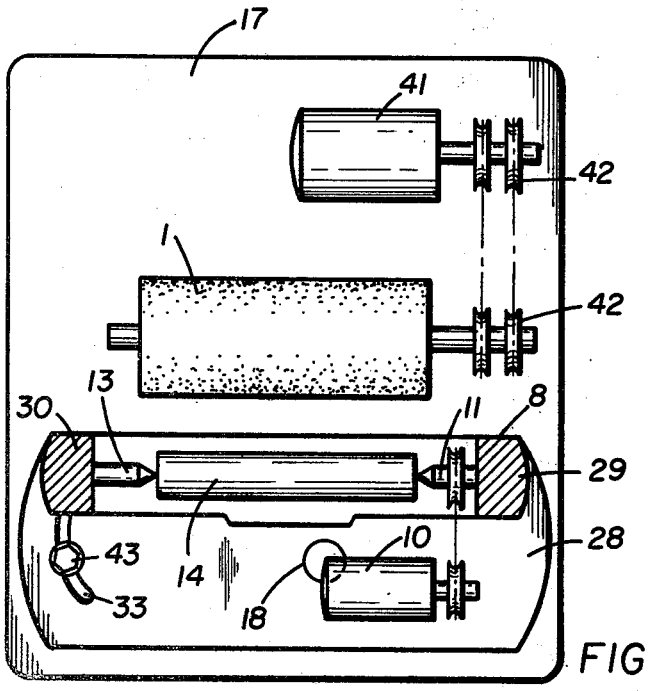
FIG. 6 is a simplified top view of the machine tool of FIG. 5.

As more simply illustrated in FIGS. 5 and 6, in accordance with the invention, the grinding wheel 1 is mounted for rotation on a horizontal axis, on the machine bed 17, and for this purpose the grinding wheel 1 may be driven by means of a conventional motor 41 mounted on the machine bed, with belts, chains, or the like (not shown) interconnecting conventional pulleys 42 on the motor and grinding wheel. The closed frame 8 is a single piece structure as especially shown in FIG. 5 and has a base 28 as best seen in FIG. 6. The base 28 is adapted to be mounted movably on the machine bed 17, for example, by means of a feed advance table (not shown). A head stock having a spindle 11 is mounted in one vertical arm of the closed frame 8, and a tail stock having a quill or sleeve 13 is mounted in the other vertical arm of the closed frame 8, so that a work piece 14 held by these members may be moved with the base 28 into and out of engagement with the grinding wheel 1. The work piece may be rotated by means of a motor 10 mounted fixedly with respect to the closed frame 8. In order to enable adjustment of the relative angular displacement between the axes of the work piece and grinding wheel, the base 28 may be mounted for angular displacement about a vertically oriented pin 18 extending, for example, from a feed advance table or the like. The angular displacement of the closed frame may be maintained by any conventional means, such as by means of a pin or screw 43 extending through an arcuate slot in the base 28 of the closed frame.

The upper cross connection 31 of the frame 8, between the tips of the arms 29 and 30, further comprises a securing surface 44 for the attachment of measuring devices, automatic work piece feed-in devices or the like.

Although the invention has been described with reference to specific example embodiments, it is to be understood, that it is intended to cover all modifications and equivalents within the scope of the appended claims.

What is claimed is:

1. A centerless grinding machine capable of operating as a centered grinding machine, comprising a machine base, slide means including guide ways and a table movably supported on said guide ways on the machine base, a closed frame structure (8), means (4) for replaceably securing said closed frame structure to said table (5), a head stock (9) secured in said closed frame structure (8), a tail stock (12) secured in said closed frame structure (8), and motor means (10) mounted to said closed frame structure (8) for driving said head stock (9), whereby the closed frame structure (8) with its head stock, tail stock and motor means form an exchangeable unit.

2. The machine tool of claim 1, wherein said closed frame has a pair of opposed vertical arms, said head and tail stocks being mounted in separate ones of said vertical arms.

3. The machine tool of claim 2, wherein said closed frame further comprises an upper cross connection between said vertical arms, and measuring means mounted to said cross connection.

4. The machine tool of claim 1, further comprising means for angularly displacing said closed frame, about a vertical axis, relative to said feed advance table, whereby the direction of feed advance of said work piece with respect to the axis of said work piece may be adjusted.

5. The machine tool of claim 1, wherein said material working tool comprises a grinding wheel having a horizontal axis, and means for rotating said grinding wheel about its axis.

6. The apparatus of claim 1, wherein said closed frame structure has two upright posts, a crossbeam rigidly interconnecting the upper ends of said posts and a base plate rigidly interconnecting the lower ends of said upright posts to form said closed frame structure, said securing means (4) replaceably securing said base plate to said table intermediate said upright posts.

* * * * *